US010820638B2

(12) United States Patent
Lin

(10) Patent No.: US 10,820,638 B2
(45) Date of Patent: Nov. 3, 2020

(54) MASK STRUCTURE

(71) Applicant: Jing-Jyr Lin, Taoyuan County (TW)

(72) Inventor: Jing-Jyr Lin, Taoyuan County (TW)

( * ) Notice: Subject to any disclaimer, the term of this patent is extended or adjusted under 35 U.S.C. 154(b) by 421 days.

(21) Appl. No.: 15/580,401

(22) PCT Filed: Jun. 8, 2016

(86) PCT No.: PCT/CN2016/085255

§ 371 (c)(1),
(2) Date: Dec. 7, 2017

(87) PCT Pub. No.: WO2016/197942

PCT Pub. Date: Dec. 15, 2016

(65) Prior Publication Data

US 2018/0160750 A1 Jun. 14, 2018

(30) Foreign Application Priority Data

Jun. 10, 2015 (CN) ..... 2015 1 0315141

(51) Int. Cl.

| | |
|---|---|
| ***A41D 13/11*** | (2006.01) |
| ***A62B 9/06*** | (2006.01) |
| ***A62B 23/02*** | (2006.01) |
| ***A62B 18/00*** | (2006.01) |

(52) U.S. Cl.

CPC ..... *A41D 13/1161* (2013.01); *A41D 13/1107* (2013.01); *A41D 13/1146* (2013.01); *A41D 13/1176* (2013.01); *A62B 9/06* (2013.01); *A62B 18/003* (2013.01); *A62B 23/025* (2013.01); *A41D 13/1192* (2013.01)

(58) Field of Classification Search

CPC ..... A41D 13/1161; A41D 13/1107; A41D 13/1146; A41D 13/1176; A41D 13/1192

See application file for complete search history.

(56) References Cited

U.S. PATENT DOCUMENTS

| | | | | |
|---|---|---|---|---|
| 3,688,768 A * | 9/1972 | Reimschussel | .... | A41D 13/1146 128/206.12 |
| 2012/0017911 A1* | 1/2012 | Choi | ..... | A62B 18/025 128/206.19 |
| 2013/0139823 A1* | 6/2013 | Lee | ..... | A62B 18/02 128/206.19 |

* cited by examiner

*Primary Examiner* — Timothy A Stanis
*Assistant Examiner* — Jonathan S Paciorek
(74) *Attorney, Agent, or Firm* — Rosenberg, Klein & Lee

(57) ABSTRACT

The present invention provides a mask structure, which comprises a first mask body, a main filtering layer, an air-isolator, and a second mask body. The main filtering layer is disposed at the first mask body. The area of the main filtering layer is smaller than the area of the first mask body. The air-isolator is disposed at the first mask body and adjacent to the periphery of the main filtering layer. The second mask body covers the main filtering layer and the air-isolator and is bonded with the air-isolator and the first mask body. Thereby, the bonding part of the mask structure can be tight and the filtering materials of the main filtering layer, such as sterilizing or adsorptive materials, will not leak from the bonding part. In addition, the air-isolator can guide the air inside and outside the mask structure to pass only through the main filtering layer for preventing the polluting particles, bacteria, or viruses inside and outside the mask structure from being propagated to the external environment or inhaled by the user.

13 Claims, 5 Drawing Sheets

MASK STRUCTURE

FIELD OF THE INVENTION

The present invention relates generally to a mask structure, and particularly to a mask structure comprising a mask body and a filtering layer, that the area of the filtering layer is smaller than the area of the mask body.

BACKGROUND OF THE INVENTION

The function of a general mask is to filter and isolate hazardous materials such as dust, bacteria, and viruses in the environment for protecting the user of the mask by reducing or preventing hazardous materials in the environment from invading the digestive or respiratory system by way of the user's mouth or nose. For example, by wearing masks, the medical personnel or worker of various levels in hospitals can protect themselves. In addition, the pollution made by the users' spit and exhalation can be avoided by wearing masks. For example, if visitors for patients in the ICU of a hospital or workers in the catering business can wear masks, pollution made by the visitors' or works' spit or droplet can be blocked and hence improving hygiene and preventing infectious diseases from spreading.

For the general public, the most direct ways to avoid flu include not to be present in the places favorable to virus spreading, washing hands frequently, and wearing masks. After several times of global widespread of SARS, the usage and demand of masks increase significantly. Thereby, masks are improved repeatedly.

Currently, masks are categorized into anti-bacterial masks, activated-carbon masks, and high-efficiency filtering masks (such as N95 masks). Here, activated-carbon masks are discussed in detail. Activated-carbon masks normally include two protective layers and an activated-carbon filtering layer disposed between two protective layers. The two protective layers and the activated-carbon filtering layer are then bonded together. Unfortunately, a plurality of activated-carbon particles will be sandwiched between the two protective layers, causing untight bonding of the two protective layers. The activated-carbon particles will leak from the space between the two protective layers. The user can be contaminated by the activated-carbon particles easily leaked from the space between the two protective layers. They can even pollute the fabrication environment and equipment, making it not possible to use activated-carbon masks in environments requiring high purity such cleanrooms. Alternatively, a non-activated-carbon filtering layer is disposed between the two protective layers. Nonetheless, the non-activated-carbon filtering layer is too thick to bond the two protective layers completely. To reduce the above problems, the density of the activated-carbon particles or the thickness of the filtering layer should be reduced, but it will cause the reduction of the lifetime of the masks.

The present invention improves the drawbacks in the prior art as described above and provides a mask structure. According to the present invention, the area of the main filtering layer is shrunk so that the main filtering layer will not be located at the junction of the mask structure. Then the above problems will be avoided; the manufacturing costs of the mask can be reduced; and the production efficiency and the yield will be improved as well. In addition, an air-isolator is further disposed at the junction of the mask structures such that the air inside and outside the mask structure can pass only through the main filtering layer. It means that the air inside and outside the mask structure must be filtered by the main filtering layer. There will be no infiltered air entering the mask structure, and hence external polluting particulates, bacteria, or viruses can be prevented from entering the mask structure. Besides, the bacteria or viruses produced inside the mask structure can be prevented from propagating to the outside.

SUMMARY

An objective of the present invention is to provide a mask structure, which comprises a main filtering layer. The area of the main filtering layer is smaller than the area of a mask body of the mask structure for preventing untight bonding of the mask body caused by the filtering material attached to the periphery of the mask body. In addition, the leakage of the filtering material of the main filtering layer from the mask structure can be prevented as well.

Another objective of the present invention is to provide a mask structure, which comprises an air-isolator connected with the periphery of the mask body for guiding the air inside and outside the mask structure to pass only through the main filtering layer. Thereby, the air inside and outside the mask structure containing polluting particulates, bacteria, or viruses are forced to pass through the main filtering layer, and therefore the air inside and outside the mask structure containing polluting particulates, bacteria, or viruses can be prevented from propagating to the outside and inside of the mask structure.

A further objective of the present invention is to provide a mask structure, which comprises an air-isolator for increasing the density of the filtering material in the main filtering layer and hence extending the lifetime of the mask structure. In addition, the main filtering layer can adopt thick and heavy materials.

The mask structure according to the present invention comprises a first mask body, a main filtering layer, an air-isolator, and a second mask body. The main filtering layer is disposed at the first mask body. The area of the main filtering layer is smaller than the area of the first mask body. The air-isolator is disposed at the first mask body and adjacent to the periphery of the main filtering layer. Besides, the second mask body is bonded with the air-isolator and the first mask body.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
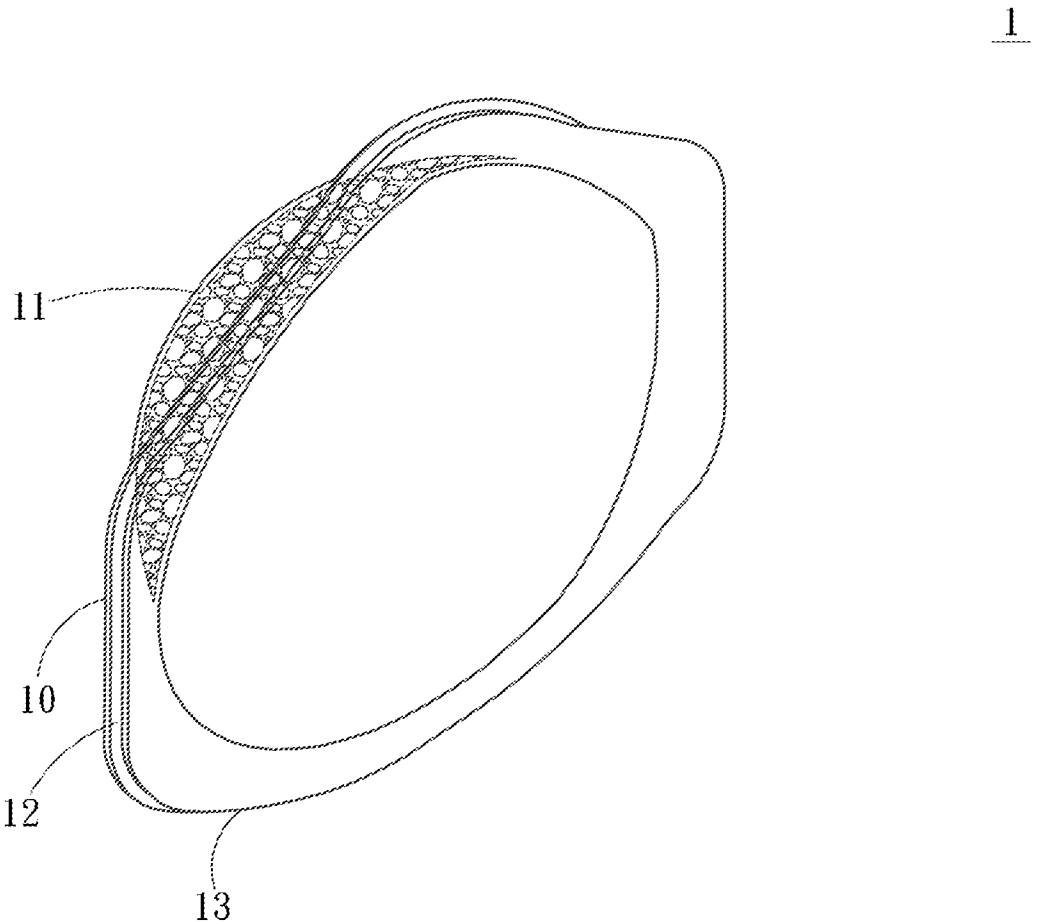
FIG. 1 shows a schematic diagram of the mask structure according to the first embodiment of the present invention.
Figure 2:
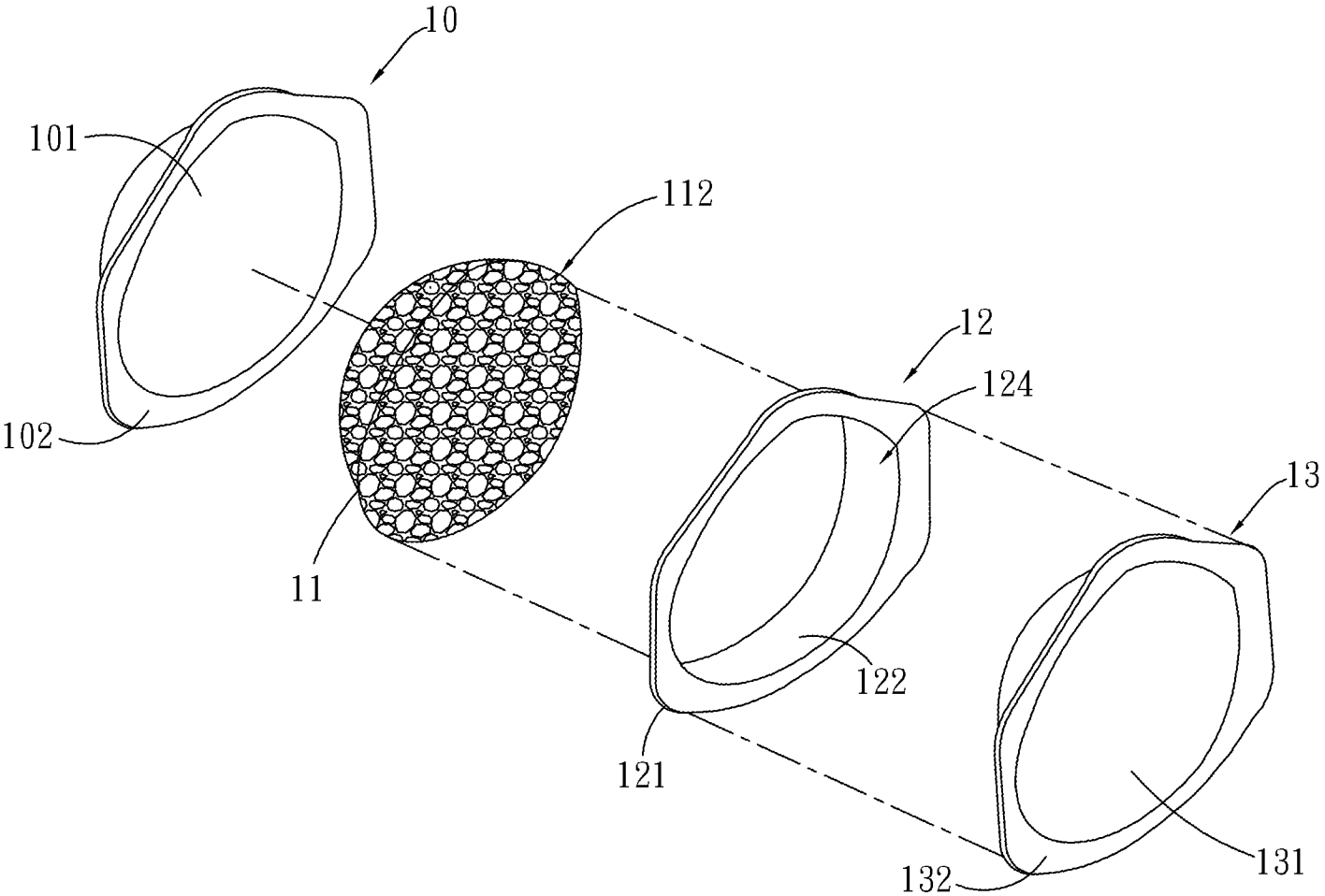
FIG. 2 shows an exploded view of the mask structure according to the first embodiment of the present invention.

Please refer to FIG. 1 and FIG. 2, which show a schematic diagram and an exploded view of the mask structure according to the first embodiment of the present invention. As shown in the figures, the present embodiment provides a mask structure 1, which comprises a first mask body 10, a main filtering layer 11, an air-isolator 12, and a second mask body 13. The first mask body 10, the main filtering layer 11, and the second mask body 13 are all ventilating materials while the air-isolator 12 is a non-ventilating material. The main filtering layer 11 is disposed at the first mask body 10 with an area smaller than the area of the first mask body 10. The main filtering layer 11 can include sterilizing or adsorptive materials. It can be a thick and heavy material with a thickness greater than 1 mm. The main filtering layer 11 according to the present embodiment includes a plurality of adsorptive materials of activated-carbon particles. The air-isolator 12 is disposed at the first mask body 10 and is annular. The air-isolator 12 includes a first annular part 121 and a second annular part 122. The inner periphery 124 of the air-isolator 12 and the periphery 112 of the main filtering layer 11 overlap. The second mask body 13 covers the main filtering layer 11 and the air-isolator 12. Then the second mask body 13, the air-isolator 12, and the first mask body 10 are bonded using, for example, but not limited to, thermal press or ultrasonic melt, to form the mask structure 1.

In other words, the first and second mask bodies 10, 13 of the mask structure 1 according to the present embodiment can be divided into filtering regions 101, 131 and bonding regions 102, 132, respectively. The filtering region 101 of the first mask body 10 corresponds to the filtering region 131 of the second mask body 13. Likewise, the bonding region 102 of the first mask body 10 corresponds to the bonding region 132 of the second mask body 13. The main filtering layer 11 is located inside the filtering region 101 of the first mask body 10 and the filtering region 131 of the second mask body 13. Thereby, the area of the main filtering layer 11 is smaller than the areas of the first and second mask bodies 10, 13, respectively.

Figure 3:
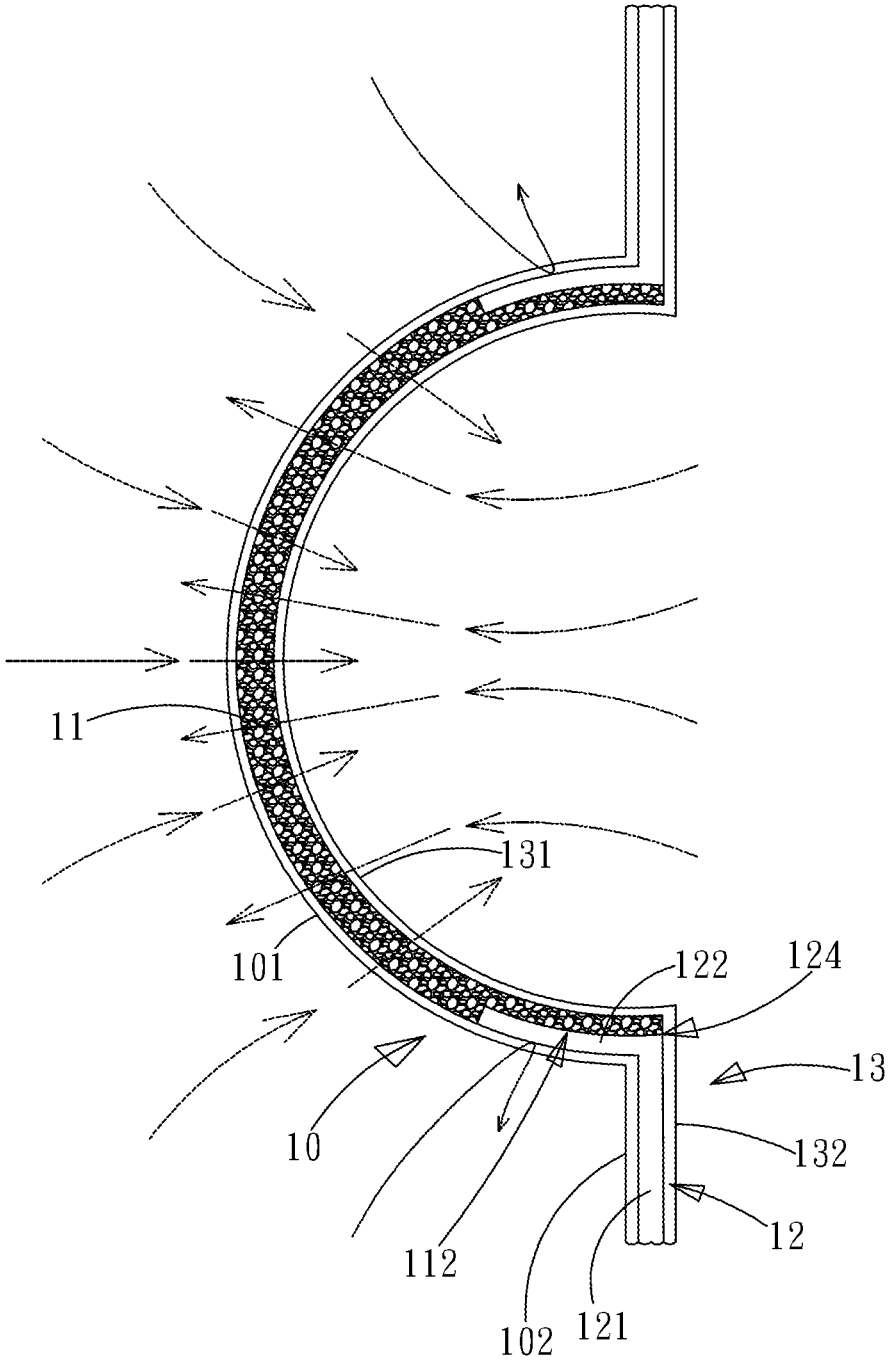
FIG. 3 shows a usage status diagram of the mask structure according to the first embodiment of the present invention.
Figure 4:
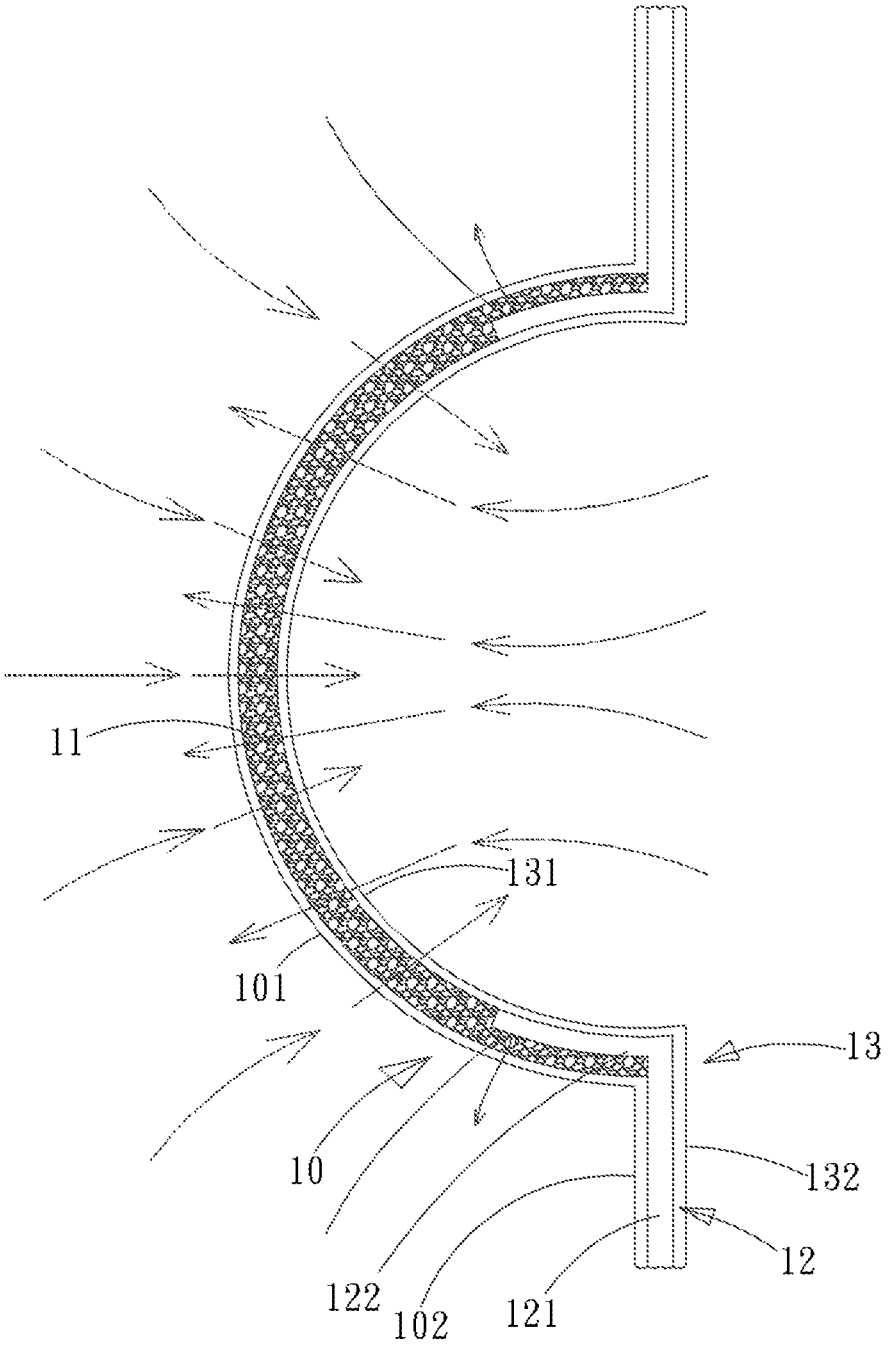
FIG. 4 shows a usage status diagram of the mask structure according to the second embodiment of the present invention.

As shown in FIG. 3, the second annular part 122 is disposed on the inner side of the first annular part 121. The outer periphery of the air-isolator 12 is located at the first annular part 121 while the inner periphery of the air-isolator 12 is located at the second annular part 122. The first annular part 121 is located in the bonding region 102 of the first mask body 10 and the bonding region 132 of the second mask body 13. The second annular part 122 is located in the two filtering regions 101, 131. Thereby, the inner periphery 124 of the air-isolator 12 overlaps the periphery 112 of the main filtering layer 11. According to the present embodiment, the second annular part 122 of the air-isolator 12 is located between the first mask body 10 and the main filtering layer 11. Alternatively, the second annular part 122 of the air-isolator 12 can be located between the second mask body 13 and the main filtering layer 11 as well, as shown in FIG. 4.

Furthermore, the first annular part 121 of the air-isolator 12 is connected with the bonding region 102 of the first mask body 10 and the bonding region 132 of the second mask body 13. The second annular part 122 of the air-isolator 12 and the main filtering layer 11 are not located in the bonding part of the first mask body 10, the air-isolator 12, and the second mask body 13.

According to the above description, the area of the main filtering layer 11 of the mask structure 1 is smaller than the areas of the first and second mask bodies 10, 13. The main filtering layer 11 is located inside the first and second mask bodies 10, 13 completely but not in the bonding part of the first mask body 10, the air-isolator 12, and the second mask body 13. Thereby, untight bonding caused by attachment of activated-carbon particles to the main filtering layer 11 will not occur in the bonding part of the first mask body 10, the air-isolator 12, and the second mask body 13. If the main filtering layer is a sterilizing material or a thick and heavy material with a thickness greater than 1 mm, the mask structure according to the present embodiment applies as well. It means that the main filtering layer 11 is not located in the bonding part of the first mask body 10, the air-isolator 12, and the second mask body 13. Then untight bonding caused by attachment of filtering materials of the main filtering layer 11 or by the excessive thickness of the main filtering layer 11 will not occur in the bonding part Because the bonding part of the first mask body 10, the air-isolator 12, and the second mask body 13 is tight, while using the mask structure 1, the activated-carbon particles of the main filtering layer 11 or other filtering materials will not leak from the bonding part of the first and second mask bodies 10, 13 and contaminate the user and the user's environment. While manufacturing the mask structure, thanks to the tight bonding, no pollution on production equipment and environment will occur, and hence improving production efficiency and yield. Moreover, because the area of the main filtering layer 11 of the mask structure 1 according to the present embodiment is smaller than the areas of the first and second mask bodies 10, 13, the manufacturing cost of the mask structure 1 is reduced. In addition, the density of the sterilizing or adsorptive materials in the main filtering layer 11 of the mask structure 1 according to the present embodiment can be increased, extending the lifetime of the mask structure 1 effectively.

Please refer to FIG. 3, which shows a usage status diagram of the mask structure according to the first embodiment of the present invention. As shown in the figure, a user wears the mask structure 1 according to the present embodiment. As the user inhales, the air outside the mask structure 1 enters the mask structure 1. Because the air-isolator 12 is made of a non-ventilating material, external air cannot penetrate the air-isolator 12. Instead, the air will flow along the air-isolator 12 and enter the filtering region of the first mask body 10. In other words, the air-isolator 12 guides external air to pass through the main filtering layer 11 only through the filtering region 101 of the first mask body 10. Then the air enters the mask structure through the filtering region 131 of the second mask body 13. In particular, the inner periphery 124 of the air-isolator 12 overlaps the periphery 112 of the main filtering layer 11. Thereby, the external air will not pass through the gap between the air-isolator 12 and the main filtering layer 11. It means that the external air will not pass through any region except the main filtering layer 11. Then all the external air can be filtered by the main filtering layer 11. Of course, the air exhaled by the user inside the mask structure 1 can be expelled from the filtering region 131 of the second mask body 13 to the main filtering layer 11 and the filtering region 101 of the first mask body 10 sequentially. The detailed will not be described in detail.

The mask structure 1 according to the present embodiment is a stereoscopic mask structure 1. Originally, the first mask body 10, the main filtering layer 11, the air-isolator 12, and the second mask body 13 are planar. When the first mask body 10, the main filtering layer 11, the air-isolator 12, and the second mask body 13 are assembled, the first mask body 10, the main filtering layer 11, the air-isolator 12, and the second mask body 13 are placed in a mold for pressing forming the stereoscopic mask structure 1. Alternatively, the first mask body 10, the main filtering layer 11, the air-isolator 12, and the second mask body 13 can be stereoscopic before assembling. Thereby, the first mask body 10, the main filtering layer 11, the air-isolator 12, and the second mask body 13 can be assembled to form the stereoscopic mask structure 1 directly. Alternatively, the mask structure 1 can be a planar mask. The details will be described in detail.

Furthermore, the first mask body 10 according to the present embodiment is a protective layer for preventing the main filtering layer 11 from pollution. The second mask body 13 is a skin friendly layer for preventing irritating the skin as well as improving the comfort while wearing the mask structure 1. The material of the air-isolator 12 according to the present embodiment can be selected form the group consisting of plastics, rubber, metal, or other non-ventilating materials. The plastic material can be polyethylene terephthalate (PET), polypropylene (PP), or polyethylene (PE). The structure of the first and second mask bodies 10, 13 and the material of the air-isolator 12 are just an embodiment of the present invention. The present invention is not limited to the embodiment.

Figure 5:
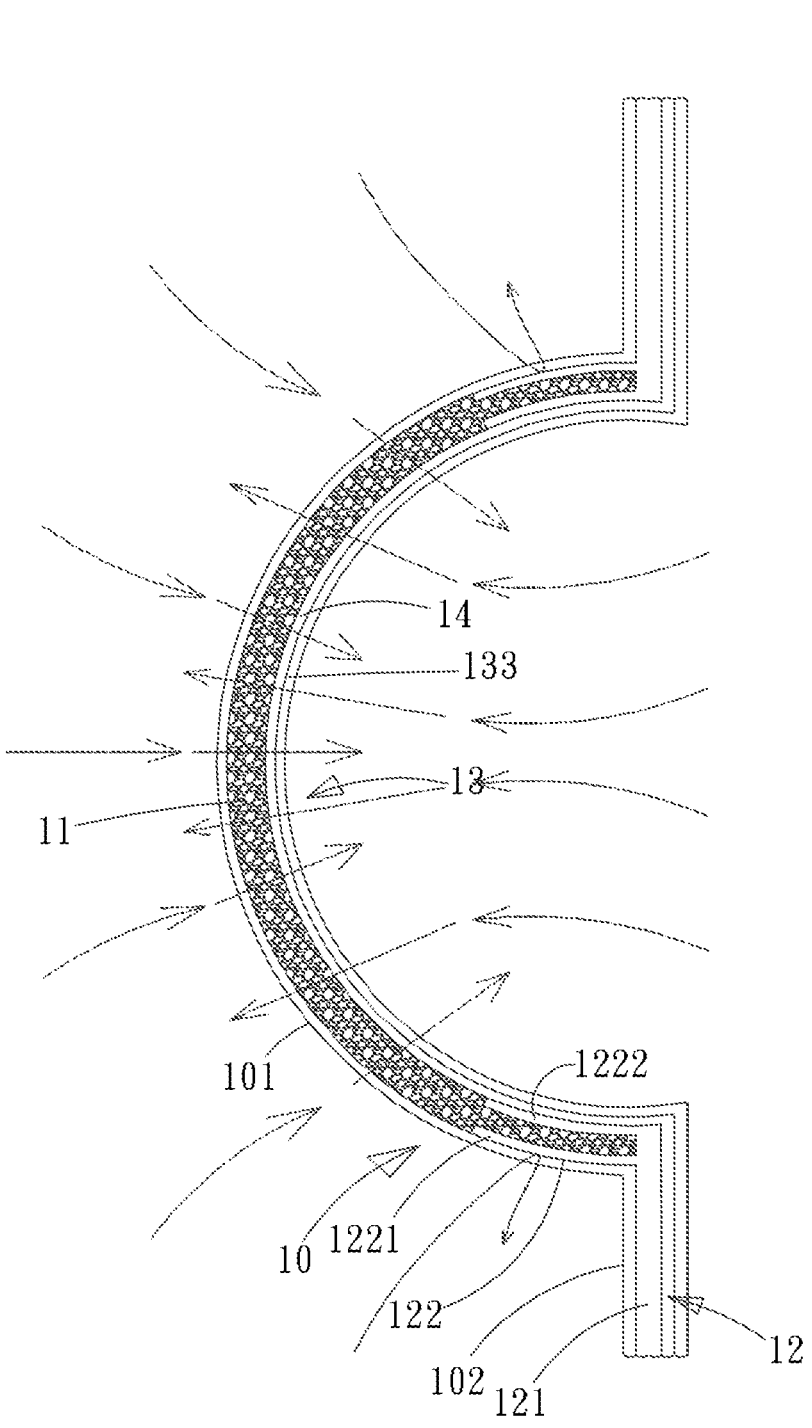
FIG. 5 shows a usage status diagram of the mask structure according to the third embodiment of the present invention.

Please refer to FIG. 5, which shows a usage status diagram of the mask structure according to the third embodiment of the present invention. As shown in the figure, the first and second annular parts 121, 122 of the air-isolator 12 according to the previous embodiment are both single-layer structures. Contrarily, the second annular part 122 of the air-isolator 12 according to the present embodiment is a double-layer structure. Namely, it includes a first isolating sheet 1221 and a second isolating sheet 1222. Thereby, the first and second isolating sheets 1221, 1222 of the second annular part 122 can clip the periphery of the main filtering layer 11. The first isolating sheet 1221 is located between the first mask body 10 and the main filtering layer 11; the second isolating sheet 1222 is located between the main filtering layer 11 and the second mask body 13. The function of the air-isolator 12 according to the present embodiment is the same as in the previous embodiment. The difference lies on the structure only.

Besides, the mask structure 1 according to the present embodiment further comprises a secondary filtering layer 14 disposed between the skin-friendly layer 133 and the main filtering layer 11. The secondary filtering layer 14 according to the present embodiment is a dust filtering layer for filtering dust particulates not filtered by the main filtering layer 11, and thus avoiding dust particulates from entering the mask structure 1. The above secondary filtering layer 14 can be replaced by an electrostatic layer, which can attract polluting particulates not filtered by the main filtering layer 11, and thus avoiding polluting particulates from entering the mask structure 11. Alternatively, two secondary filtering layers 14 can be disposed in the mask structure 1. That is to say, a dust filtering layer and an electrostatic layer can be disposed inside the mask structure 1. Their functions have been described above, Hence, the details will not be described again.

To sum up, the present invention provides a mask structure. The main filtering layer is disposed between the first and second mask bodies. Because the area of the main filtering layer is smaller than the areas of the first and second mask bodies, the main filtering layer will be located inside the two filtering regions of the first and second mask bodies and thus reducing the cost of the mask structure effectively. In addition, the air-isolator is disposed between the first and second mask bodies and located in the two bonding regions of the first and second mask bodies. Thereby, the main filtering layer will not be in the two bonding regions of the first and second mask bodies, avoiding the influence of the filtering materials and the thickness of the main filtering layer on the bonding of the first mask body, the air-isolator, and the second mask body. Besides, the leakage of the filtering materials of the main filtering layer from the bonding part of the first and second mask bodies can be avoided as well.

Moreover, the air-isolator can prevent the air inside and outside the mask structure from passing through the region outside the main filtering layer. In other words, the air inside and outside the mask structure must pass and be filtered by the main filtering layer for preventing the polluting particulates, bacteria, or viruses in the external air from entering the mask structure and being inhaled by the user, as well as preventing the polluting particulates, bacteria, or viruses inside the mask structure from propagating to the outside of the mask structure. In addition, the mask structure according to the present invention can adopt a high-density main filtering layer or a main filtering layer made of thick and heavy materials for extending the lifetime of the mask structure according to the present invention effectively.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A mask structure, comprising:

a first mask body;

a main filtering layer, disposed at said first mask body, and having an area smaller than the area of said first mask body;

an air-isolator, disposed at said first mask body, and having an inner periphery overlapping the periphery of said main filtering layer; and a second mask body, bonded to said air-isolator and said first mask body;

wherein said first mask body and said second mask body each include a filtering region and a bonding region; said filtering region of said first mask body corresponds to said filtering region of said second mask body; said bonding region of said first mask body corresponds to said bonding region of said second mask body; said main filtering layer is located in said two filtering regions; said air-isolator is connected with said bonding region of said first mask body and said bonding region of said second mask body; and said main filtering layer is not located in said two bonding regions and the bonding part of said first mask body, said air-isolator, and said second mask body.

2. The mask structure of claim 1, wherein said first mask body is a protective layer.

3. The mask structure of claim 1, wherein said second mask body is a skin-friendly layer.

4. The mask structure of claim 3, further comprising a secondary filtering layer located between said skin-friendly layer and said main filtering layer.

5. The mask structure of claim 4, wherein said secondary filtering layer is a dust filtering layer or an electrostatic layer.

6. The mask structure of claim 4, wherein said secondary filtering layer is a dust filtering layer and an electrostatic layer.

7. The mask structure of claim 1, wherein the material of said air-isolator is selected from the group consisting of rubber, plastics, metal, and other non-ventilating materials.

8. The mask structure of claim 1, wherein said main filtering layer includes sterilizing materials or adsorptive materials.

9. The mask structure of claim 8, wherein said adsorptive materials are a plurality of activated-carbon particles.

10. The mask structure of claim 1, wherein said air-isolator includes:

a first annular part, located inside said two bonding regions; and a second annular part, disposed on the inner side of said first annular part, and located inside said two filtering regions.

11. The mask structure of claim 10, wherein said second annular part is located between said first mask body and said main filtering layer.

12. The mask structure of claim 10, wherein said second annular part is located between said second mask body and said main filtering layer.

13. The mask structure of claim 10, wherein said second annular part includes a first isolating sheet and a second isolating sheet; said first isolating sheet is located between said first mask body and said main filtering layer; and said second isolating sheet is located between said second mask body and said main filtering layer.

* * * * *